US010472896B2

(12) United States Patent
Collins et al.

(10) Patent No.: US 10,472,896 B2
(45) Date of Patent: Nov. 12, 2019

(54) DOWNHOLE TOOL AND METHOD OF MANUFACTURING A TOOL

(71) Applicant: ESCO Corporation, Portland, OR (US)

(72) Inventors: Calvin William Collins, West Linn, OR (US); Jon V. Owen, West Linn, OR (US); Alfred H. Skinner, Aledo, TX (US); Neal Alan Bowden, Mansfield, TX (US); Ryan J. Nelson, Portland, OR (US)

(73) Assignee: ESCO GROUP LLC, Portland, OR (US)

( * ) Notice: Subject to any disclaimer, the term of this patent is extended or adjusted under 35 U.S.C. 154(b) by 839 days.

(21) Appl. No.: 14/945,203

(22) Filed: Nov. 18, 2015

(65) Prior Publication Data

US 2016/0138343 A1 May 19, 2016

Related U.S. Application Data

(60) Provisional application No. 62/082,128, filed on Nov. 19, 2014.

(51) Int. Cl.
*E21B 10/42* (2006.01)
*B22D 19/06* (2006.01)

(52) U.S. Cl.
CPC ..... *E21B 10/42* (2013.01); *B22D 19/06* (2013.01)

(58) Field of Classification Search
CPC ..... E21B 10/00; E21B 10/55; E21B 10/42; E21B 10/54; B22C 9/02; B22C 9/10
See application file for complete search history.

(56) References Cited

U.S. PATENT DOCUMENTS 3,298,451 A * 1/1967 Eckel ..... E21B 10/54 175/393
3,312,285 A * 4/1967 Solum ..... E21B 17/1028 166/172
4,104,347 A 8/1978 Ohashi et al.
4,423,646 A * 1/1984 Bernhardt ..... B22C 9/046 164/34
4,623,027 A * 11/1986 Vezirian ..... E21B 10/20 175/340
5,358,026 A * 10/1994 Simpson ..... B22D 19/06 164/112
5,740,873 A * 4/1998 Tibbitts ..... E21B 10/55 175/393
5,839,329 A * 11/1998 Smith ..... B22F 3/1055 76/108.2
5,893,204 A 4/1999 Symonds
6,131,677 A * 10/2000 Arfele ..... B22C 7/023 164/34
6,209,420 B1 * 4/2001 Butcher ..... B22F 3/1055 419/28
6,286,581 B1 9/2001 Gustafson
6,296,069 B1 * 10/2001 Lamine ..... E21B 10/46 175/348
6,386,264 B2 5/2002 Gustafson
(Continued)

*Primary Examiner* — Daniel P Stephenson
(74) *Attorney, Agent, or Firm* — Steven Schad

(57) ABSTRACT

Producing a drag bit includes creating a mold corresponding to the surface of the bit and inserting a core in the mold corresponding to the plenum of the bit. A preliminary shaped bit is cast in the mold. Excess material is removed from the casting to produce a final shaped bit.

7 Claims, 10 Drawing Sheets

(56) References Cited

U.S. PATENT DOCUMENTS

| | | | | |
|---|---|---|---|---|
| 6,454,030 | B1 * | 9/2002 | Findley | B22F 7/06 175/425 |
| 7,694,608 | B2 * | 4/2010 | Squier | E21B 10/60 175/339 |
| 7,832,456 | B2 | 11/2010 | Calnan et al. | |
| 7,832,457 | B2 | 11/2010 | Calnan et al. | |
| 2009/0025984 | A1 * | 1/2009 | Buteaud | B22C 9/22 175/421 |
| 2010/0133805 | A1 * | 6/2010 | Stevens | E21B 10/00 285/18 |
| 2010/0320005 | A1 * | 12/2010 | Burhan | B22F 7/06 175/426 |
| 2011/0000718 | A1 * | 1/2011 | Bankes | E21B 10/00 175/434 |
| 2011/0167734 | A1 * | 7/2011 | Jiang | B22C 9/02 51/309 |
| 2012/0018158 | A1 * | 1/2012 | Misselbrook | E21B 29/00 166/298 |
| 2012/0125695 | A1 * | 5/2012 | Vempati | E21B 10/006 175/428 |
| 2016/0138343 | A1 * | 5/2016 | Collins | E21B 10/42 175/327 |

* cited by examiner

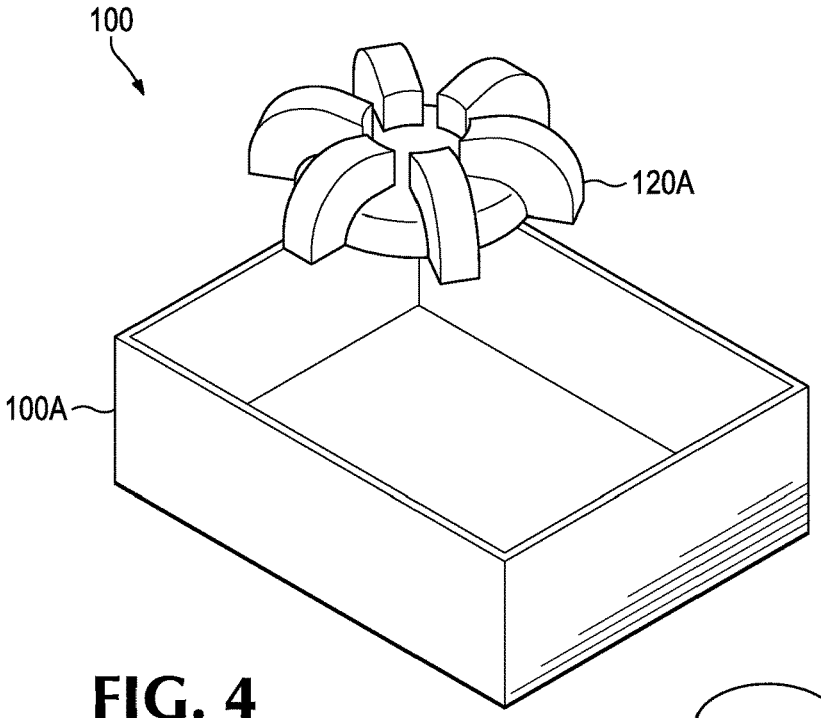
FIG. 4
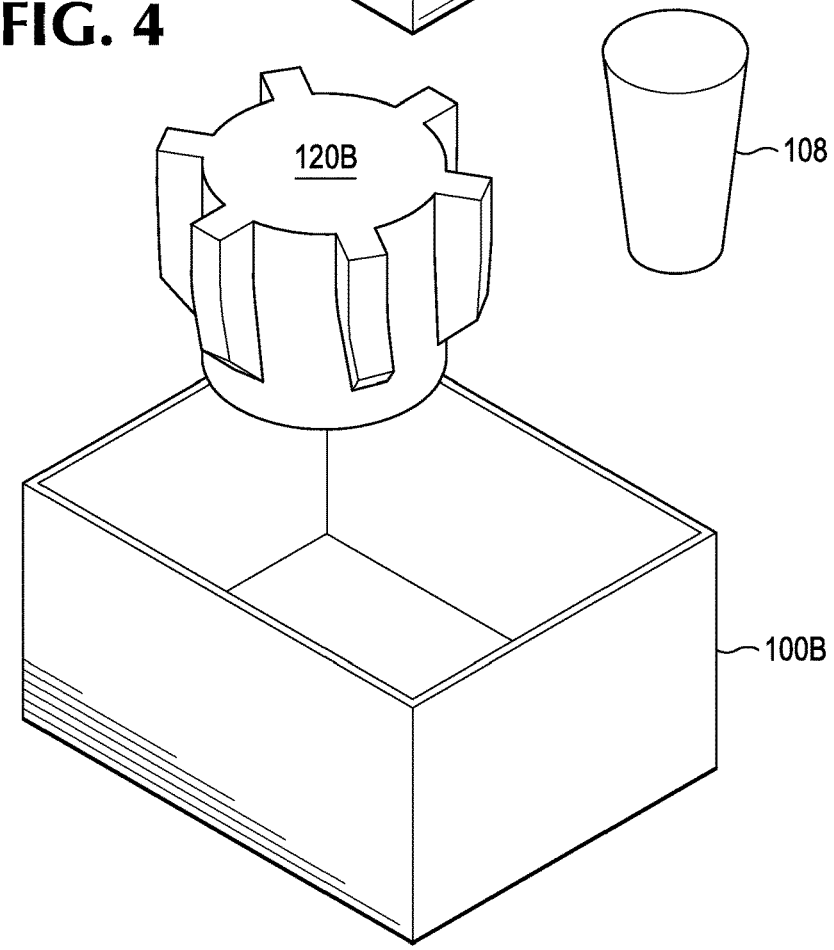

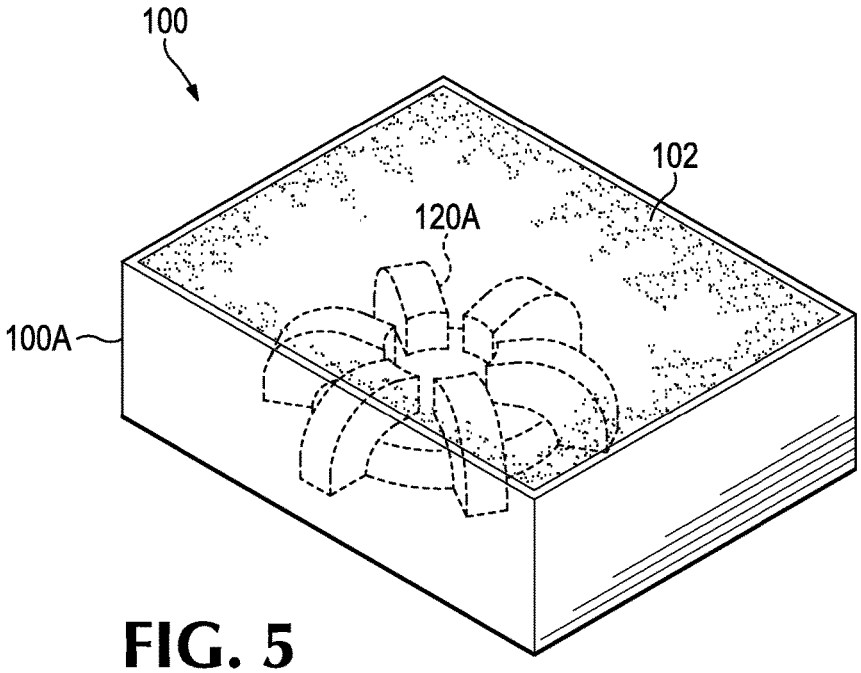
FIG. 5
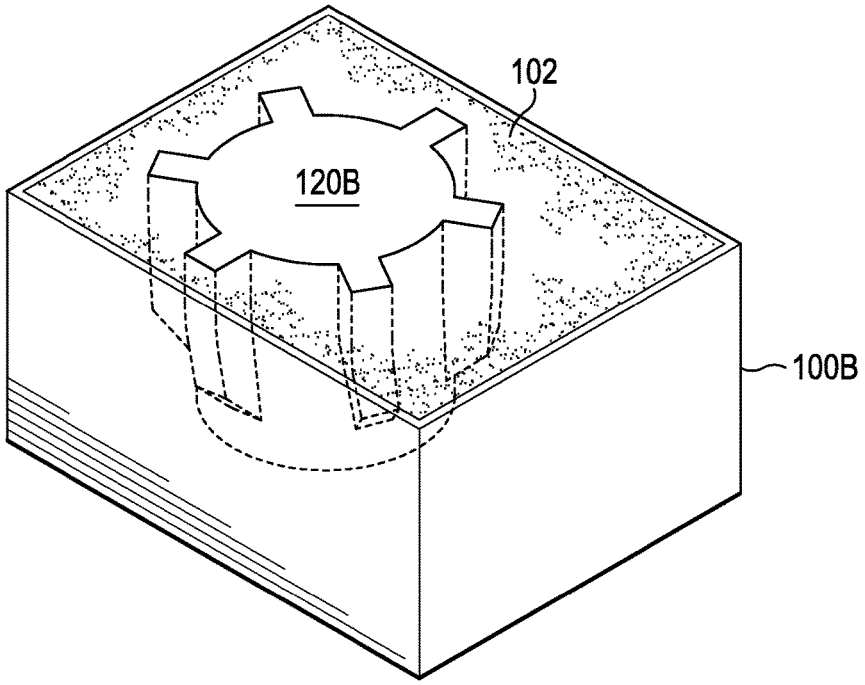

DOWNHOLE TOOL AND METHOD OF MANUFACTURING A TOOL

TECHNICAL FIELD OF THE INVENTION

This invention is related in general to the field of drill tools. More particularly, the invention is related to steel tools for advancing a borehole.

BACKGROUND OF THE INVENTION

In a typical drilling operation, a drill bit is rotated while being advanced into a formation within the earth. There are several types of drill bits, including roller cone bits, hammer bits and drag bits. There are many kinds of drag bits with various configurations of bit bodies, blades and cutters.

Drag bits typically include a body with a plurality of blades extending from the body with a face at a front end and a mounting pin at a rear end. The bit can be made of steel alloy, a tungsten matrix or other material. Drag bits typically have no moving parts and are formed as a single-piece body with cutting elements brazed or attached into the blades of the body. Such bits are commonly manufactured by milling a billet or sintering a powder matrix in a mold. Each blade supports a singular or a plurality of discrete cutters on the leading edge of the blades that contact, shear, grind and/or crush the rock formation in the borehole as the bit rotates to advance the borehole.

The drill string and the bit rotate about a longitudinal axis and the cutters mounted on the blades sweep a radial path in the borehole to fail rock. Cutters can be made from any durable material, but are conventionally formed from a tungsten carbide backing piece, or substrate, with a front facing table comprised of a diamond or other suitable material. The tungsten carbide substrates are formed of cemented tungsten carbide comprised of tungsten carbide particles dispersed in a cobalt binder matrix.

FIG. 1 is a schematic representation of a drilling operation 2. In conventional drilling operations a drill bit 10 is mounted on the lower end of a drill string 6 comprising drill pipe and drill collars. The drill string may be several miles long and the bit is rotated in the borehole 4 either by a motor proximate to the bit or by rotating the drill string, or both simultaneously. A pump 8 circulates drilling fluid through the drill pipe and out of the drill bit to flush rock cuttings from the bit and move them back up the annulus of the borehole. The drill string comprises sections of pipe that are threaded together at their ends to create a pipe of sufficient length to reach the bottom of the borehole 4.

Steel bits are generally machined from a single billet to produce a bit with a body and blades. Recesses to receive cutters are machined into the blades and often require special machining steps and techniques to reach parts of the blades that are obstructed by adjacent blades. A plenum is machined into the rear of the bit. The plenum is drilled with a single point tool and widened by boring. Boring is used to achieve greater accuracy in the diameter of a hole, and can be used to cut a tapered hole or enlarge a portion of a hole. Boring uses a boring tool that includes a long bar used to position a single-point tool for boring operations.

With the plenum created, the ducts are drilled from the outside face of the bit to the plenum. Drilling fluid pumped down the drill string flows through the plenum and ducts to the face of the bit to flush away cut material. An open and unrestricted duct inlet in the plenum limits turbulence or cavitation in the fluid flow as it enters the duct. Bit configurations are typically limited to including only ducts with inlets positioned near the center of the plenum on account of the difficulty under current manufacturing processes of forming ducts with expanded inlet portions for the desired flow patterns in the ducts. Accordingly, the use of ducts in other locations (e.g., near corners or walls of the plenum) is generally avoided regardless of their desirability to the performance of the bit. Machining surface features in the plenum to accommodate special duct configurations add significant cost to the bit.

An improved ferrous drill bit and a manufacturing method for ferrous bits that is less complex and costly, involves fewer steps, and encompasses a broader range of options for duct configurations would be advantageous.

SUMMARY OF THE INVENTION

The present invention generally pertains to drilling operations where a rotating bit with cutters advances a borehole in the earth. The bit is attached to the end of a drill string and is rotated to fail the rock in the borehole. Cutters on blades of the bit contact the formation and fail the rock of the borehole by shearing or crushing. Other downhole tools such as bi-center bits, reamers, hole openers, core bits, sleeves and impreg bits perform functions to prepare the borehole for production.

In one aspect of the present invention, a method of manufacturing a downhole tool includes casting a ferrous body to a preliminary shape and machining it to a final shape. Casting the tool to a preliminary shape reduces the amount of machining required to produce a body with extending blades as compared to machining a cylindrical steel billet. The reduced machining limits the number of milling cutters and milling cutter changes required during processing.

In another aspect of the invention, a cast steel tool includes an exterior surface defining a body and blades projecting from the body that are at least partially machined to their final configuration, and an internal plenum that remains fully or at least partially unmachined, i.e., retaining its cast configuration.

In another aspect of the invention, a mold is created corresponding to a bit body with blades. A core corresponding to a plenum of the bit body is mounted in the mold. Molten metal is poured into the mold and allowed to cool and solidify to form a casting of the preliminary shape of the bit. The casting is removed from the mold. The preliminarily shaped bit is machined to remove material from the blades and produce a net or final shape bit. Core material is removed from the plenum.

In another aspect of the invention, a steel casting includes a body, blades extending from the body and a plenum in the body. A final or net shape bit is produced by removing material from the blades of the casting. The plenum, at least in part, retains an as-cast surface.

In another aspect of the invention, a method of forming a plenum for a drag bit comprises forming a core of refractory material to a shape corresponding to the plenum. The core includes an axis, an upper throat with a radius, a wall and a lower face. The method further includes positioning the core in a cavity of a drag bit mold and pouring molten ferrous material into the drag bit mold cavity. The transition between the wall and the face has a radius of curvature greater than one tenth of the radius of the throat.

In another aspect of the invention, a core(s) is used to produce final or preliminary shape ducts in the body of the cast bit or (alternatively or in concert) enlarged transition segments from the plenum to the ducts to improve fluid flow through the ducts. Preferably, the external surface of the bit body is machined to a final or net shape. The plenum and transition segments preferably remain without machining, though some or extensive machining could be done inside the bit.

In another aspect of the invention, cores in the mold that form the ducts in the bit body are connected to the core that forms the plenum and the duct cores at least in part support the plenum core in the mold. In another aspect of the invention the core for the plenum includes extensions that correspond to openings or cavities proximate to the inlet for the ducts to promote preferred fluid flow into the duct. The preferred flow in the ducts or at the inlet to the ducts could be laminar or turbulent. In another aspect of the invention, the cores corresponding to the ducts of the bit are arcuate extending away from the duct inlet. The plenum can include extensions that limit the mass of the bit body at the root of the blades.

In another aspect of the invention, threads are machined on the cast bit body for mounting the bit to a drill string along with the blades, cutter recesses and the like.

In another aspect of the invention, the mold includes features corresponding to recesses in the blades to receive cutters. The recesses can be cast in their final condition or a preliminary condition where they are machined to their final condition.

In another aspect of the invention, the method of creating a bit includes heat treating the preliminary shape bit to reduce hardness; i.e., depending on the nature of the steel in the cast bit, it may be beneficial to the machining to reduce the hardness of the cast bit beforehand. Alternatively, in another aspect of the invention, the method of creating a bit includes heat treating the final or net shape bit or the machined cast bit to increase hardness.

In another aspect of the invention the mold includes a cope and a drag that define the exterior surface of the bit and at least one core to form a void in the bit casting. In another aspect of the invention, the mold is formed at least in part by machining voids in a mold material. In another aspect of the invention, the mold and/or cores are created by a three dimensional (3D) printer. In another aspect of the invention the steel material of the cast bit is selected for compatibility with corrosive materials encountered in boreholes.

Other aspects, advantages, and features of the invention will be described in more detail below and will be recognizable from the following detailed description of example structures in accordance with this disclosure.

BRIEF DESCRIPTION OF THE DRAWINGS

FIG. 4 is a perspective view of components for a sand mold.

FIG. 5 is a perspective view of a cope and drag with molding sand packed around patterns for a bit.

DETAILED DESCRIPTION OF THE INVENTION

Bits used in downhole boring operations such as for gas and oil exploration operate at extreme conditions of heat and pressure often miles underground. Drag bits most often include PDC cutters mounted on blades of the bit that engage the surfaces of the borehole to fail the rock in the borehole. Each cutter is retained in a recess of the blade and secured by brazing, welding or other method. Drilling fluid is pumped down the drill string through the plenum, ducts and nozzles in the bit to flush the rock cuttings away from the bit and up the borehole annulus.

Figure 1:
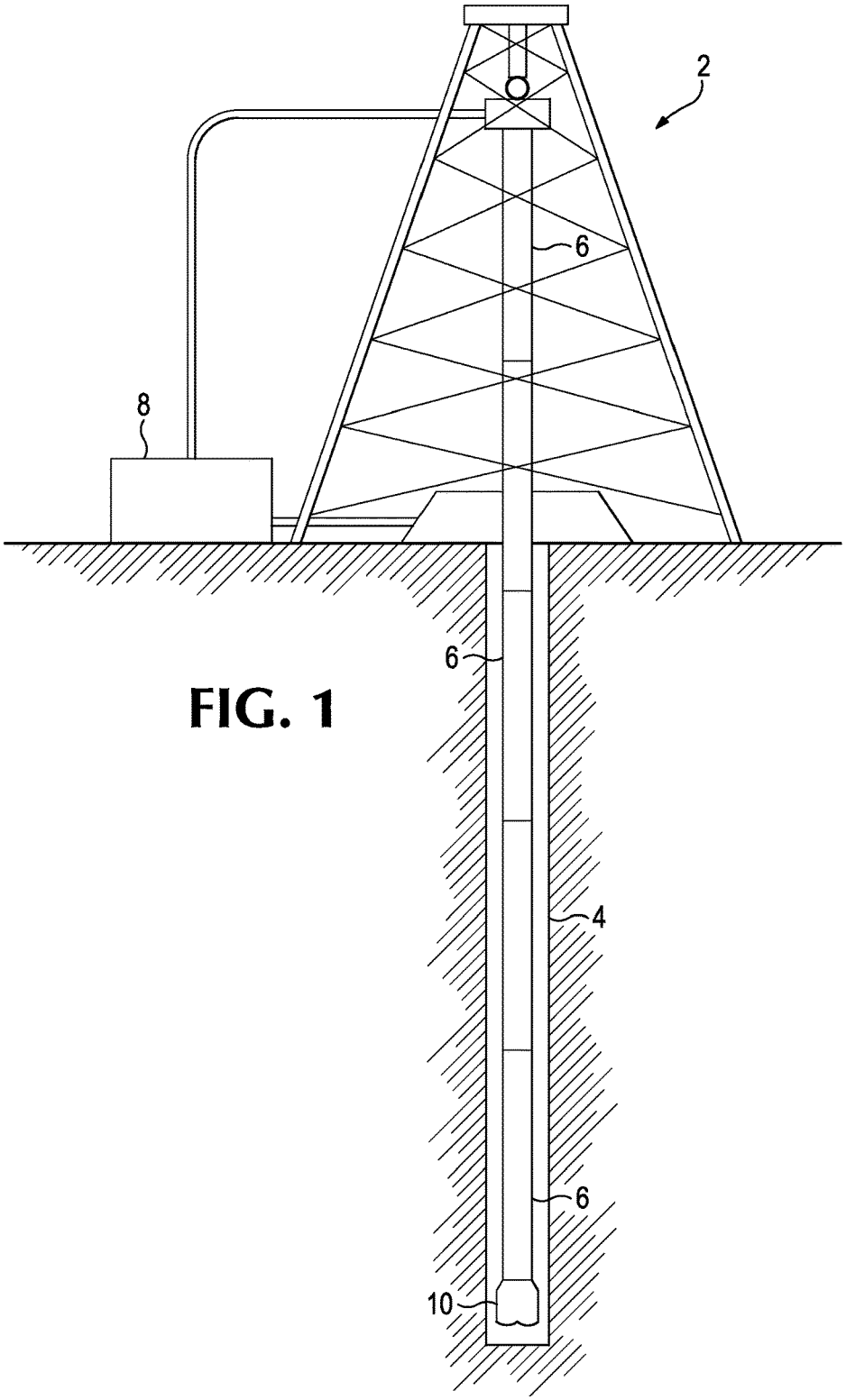
FIG. 1 is a schematic depiction of a drilling system.
Figure 2:
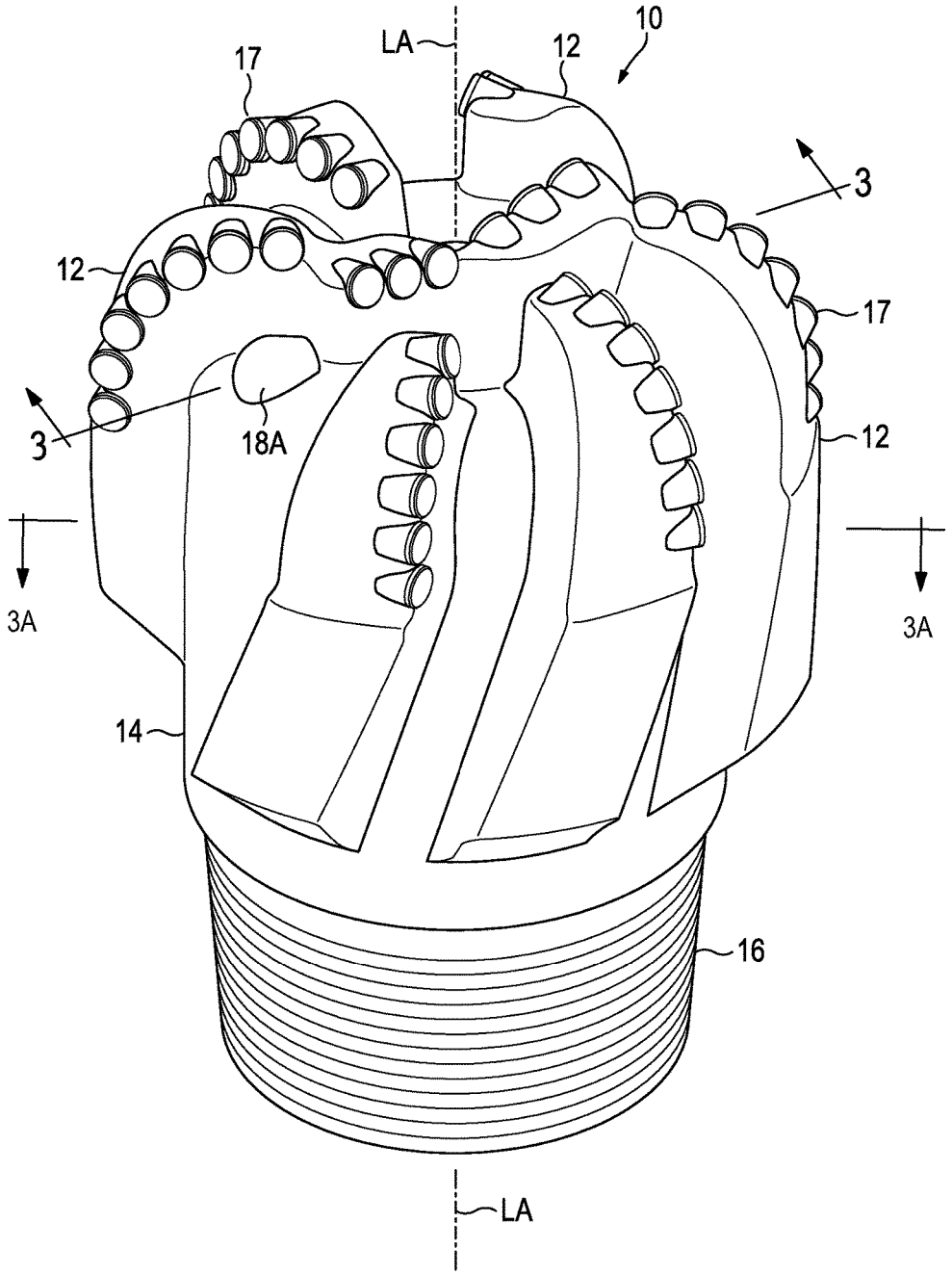
FIG. 2 is a perspective view of a bit.
Figure 3:
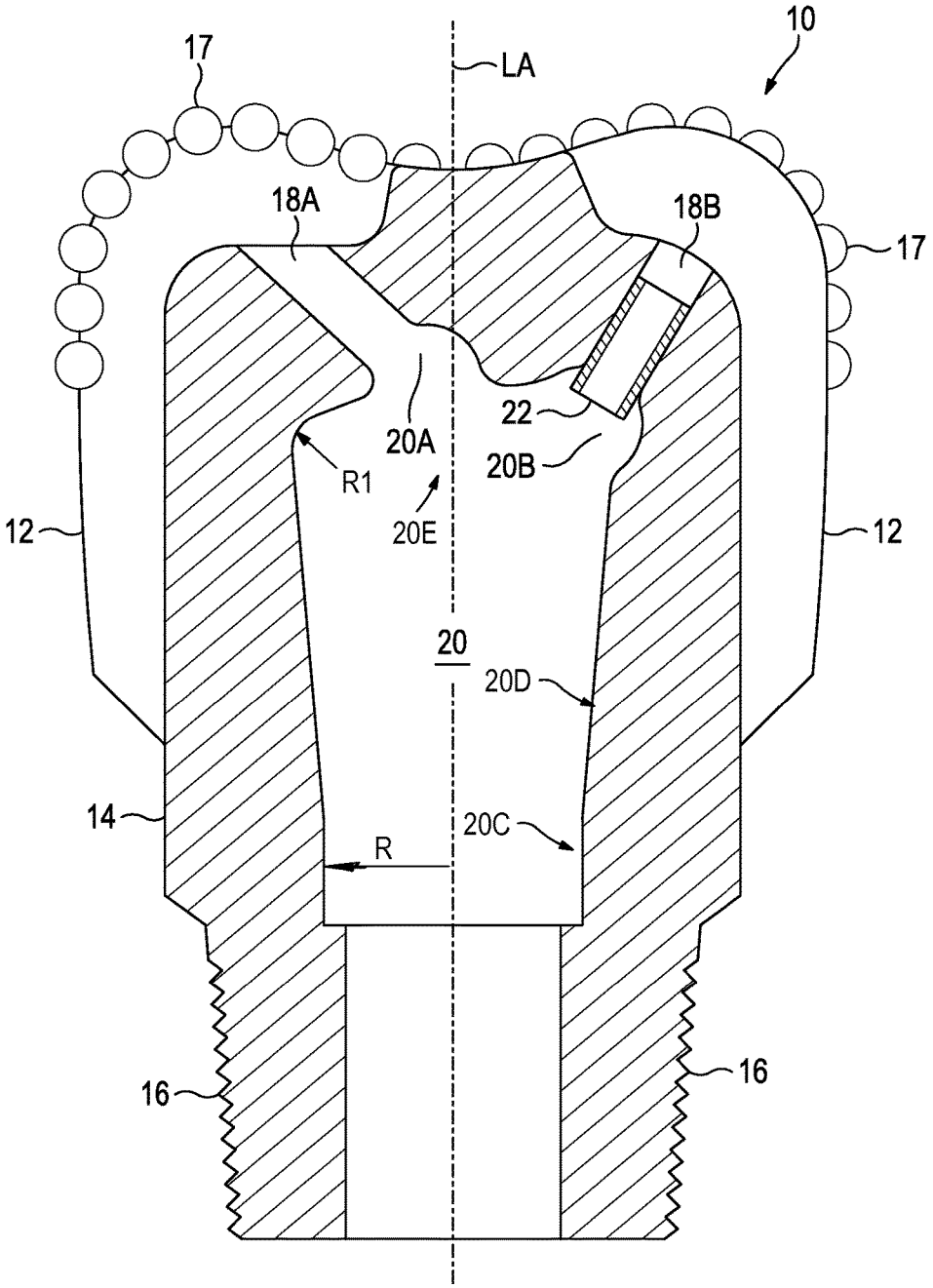
FIG. 3 is a cross section view of the bit of FIG. 2.

A bit is shown generally in FIGS. 2 and 3. The bit 10 includes blades 12 extending from a body 14. The blades support cutters 17. A plenum 20 opens at a throat 20C at the rear end of the bit and extends forward toward the bit face. The body 14 rotates about the longitudinal or rotational axis LA of the bit. An axis of the plenum generally corresponds with the axis of the bit. The plenum throat has a radius R.

The rear end of the bit has a threaded collar or pin 16 with an internal passage for connecting the bit to the drill string. The pin can be manufactured separately and attached to the body 14 extending the plenum. The pin can be welded or otherwise attached to the bit body. Sleeves can also be welded to the bit extending rearward. Alternatively, the pin 16 may be cast as part of the body and the threads of the pin machined into the bit body.

While a drag bit is described in these examples, this is for the purpose of illustration. These methods can be used in the manufacture of any kind of downhole tool such as bi-center bits, reamers, hole openers, core bits, sleeves and impreg bits.

The bit is formed by casting a preliminary shape bit in a mold 100. Preferably, the preliminary shape is a near net shape that closely resembles the final shape of the bit, i.e., preferably as close as practicable allowing for the casting tolerances. This preferred construction reduces the amount of machining required, which in turn should reduce time of manufacture, costs, and machining materials. Nevertheless, the preliminary shape may rely on loose tolerances or simply approximate or resemble the final shape of the bit to lessen the amount of machining required as compared to conventional manufacturing processes where the bit is machined completely from a billet. These alternatives may, in some situations, enable the use of a faster, easier, and less costly casting process.

The casting process is carried out by known means. While sand casting is preferred, other known casting procedures such as investment casting can also be used. In general, for sand casting, a mold 100 can comprise a cope 100A and drag 100B which are upper and lower assemblies, each holding a refractory molding material 102 such as sand or other heat resistant material with a binder. Mold cavities 104 and 106 can be formed in one or both of the cope and drag. The cavity surfaces correspond to surface features of the bit. These mold features will preferably create by casting the preliminary shape of the bit. The mold cavities can include additional voids 104A and 106A corresponding to features of the bit such as blades 12.

Refractory materials can include silica, graphite, alumina, magnesia, chromia or other heat resistant materials. While the casting metal is referred to in examples as steel, this is an example and other casting materials can be used such as cast iron, ductile iron, chrome iron, stainless steel or white iron. In a preferred embodiment the cast bit is at least 90% iron.

FIGS. 4-7 generally illustrate steps in casting a bit. Hidden lines are shown as dotted lines in several figures. Cope and drag boxes 100A and 100B together with a cope pattern 120A, a drag pattern 120B and core 108 corresponding to the plenum are shown in FIG. 4. The cope and drag boxes typically have sides and the top and bottom are open. For each of the cope and drag boxes the patterns are placed on the table with the box around it. Sand typically with a binder is packed in the box and around the pattern. When the binder hardens or the sand is sufficiently set, the box can be flipped and the pattern extracted to leave the cavity in the casting sand corresponding to the pattern. Lower pattern 120B is shown here with blades with a helical twist. The blades may also taper extending downward. The pattern can be rotated about its axis as it is raised out of its sand cast, the blades separating from the sand without interference to the cavity configuration. The blade pattern shown is an example for the purpose of illustration. A range of blade configurations can be accommodated by the casting process. The orientation of the casting can also be different than that shown. For example the face and blades of cavity 106 can be at the bottom of the casting rather than the top.

The core 108 is positioned in the cavity of the mold. Cope 100A is positioned on drag 100B to form a cavity corresponding to the shape of the bit. A sprue and runner 100C are shown opening to the top of the cope and to the cavity 104 for receiving and channeling the molten steel 130 to the cavity. A riser 100D is shown opening to the top of the cope that receives overfill of the molten steel and provides a reservoir to compensate for shrinkage of the casting during solidification. This is one configuration of a mold for casting a bit.

Figure 8:
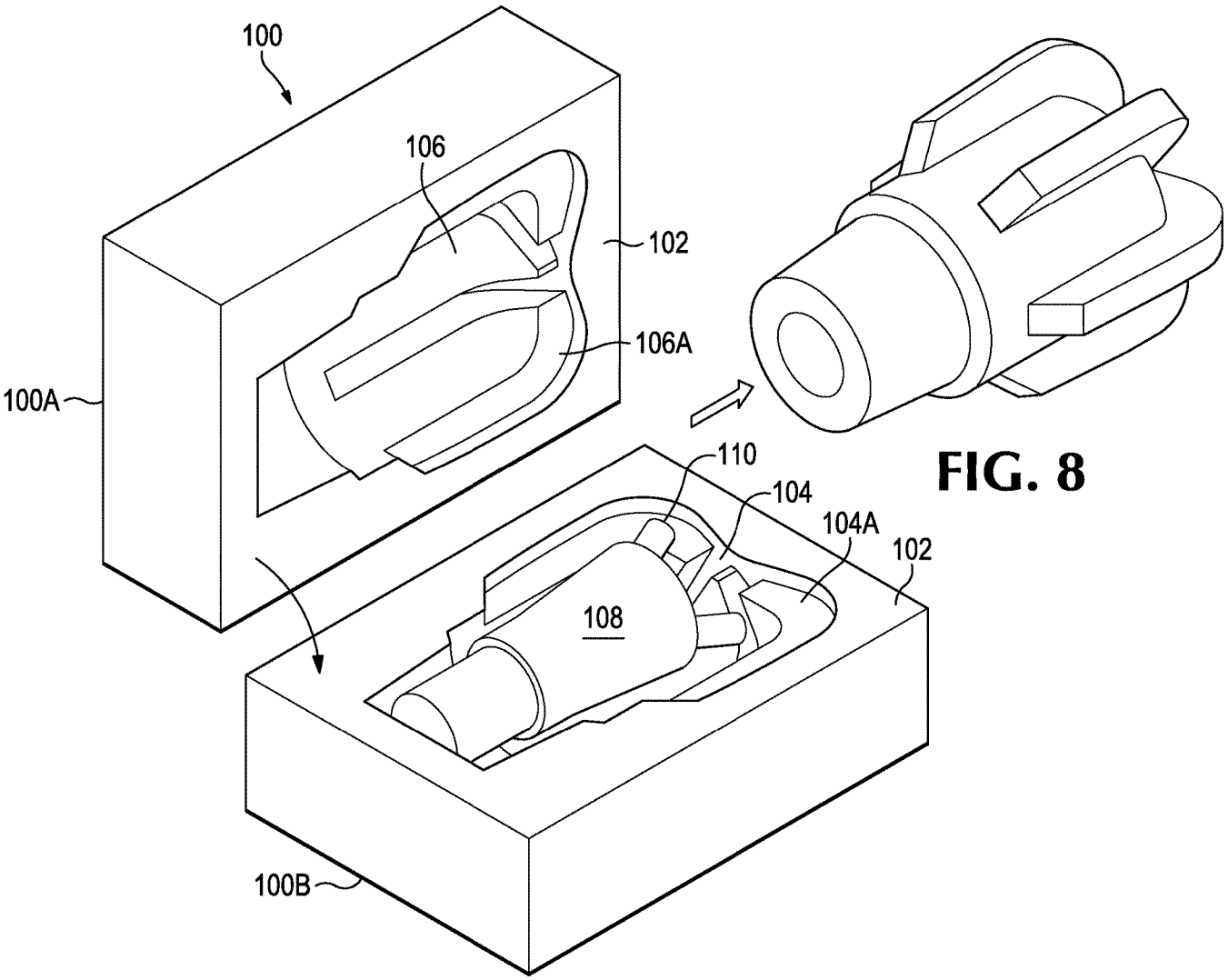
FIG. 8 is a perspective exploded view of an alternative configuration of a cope, a drag and a core for casting a bit.

FIG. 8 shows an alternative configuration of a mold. Here a cope and mold are shown with a different orientation for the bit cavity and the core. The axis of the bit and cavity are orthogonal to the previous example and the blades exhibit backdraft. Backdraft prevents removal of a one-piece pattern corresponding to the bit from the sand without displacing sand and disrupting the cavity configuration. Backdraft can be configured in the mold using inserts separate from the pattern to form voids 104A and 106A corresponding to the blades and a pattern that corresponds to the body of the bit. The pattern can be removed from the sand and the inserts removed separately from the pattern.

Alternatively, the cavities and voids can be formed in the molding material by machining away the molding material to the desired configuration. Metal casting techniques such as these are well understood by those skilled in the art.

Cores 108 and 110 corresponding to passages in the bit such as the plenum and ducts are positioned in the cavities of the drag and cope. The cores can be configured from a similar refractory material as the mold or can be a contrasting material with different properties. Runners, risers, sprues and feeders can again be formed in the mold to introduce the molten metal to the cavities and promote complete flow of the molten metal into the cavities. With the cope and drag joined, the mold cavities 104 and 106 together correspond to the surface of the body and blades of the bit. Molten metal poured into the mold flows around the cores and fills the mold cavities. As the molten metal solidifies it forms a preliminary shape casting 10A of the bit 10. The mold is generally sized and configured to compensate for shrinkage of the molten metal as it solidifies. The casting 10A is removed from the mold and the core material is removed from the casting to clear the ducts and the plenum. Although a general discussion of the casting process has been provided, many variations known within the foundry industry could be used.

To produce a final or net shape bit 10, material is removed from the casting 10A. Blades 12 can be machined to dimensions to produce the desired borehole diameter. Recesses can be machined into the blades for mounting cutters 17 that engage and fail rock to advance the borehole. Alternatively, the recesses can be cast to their final condition or preliminarily formed to lessen the amount of required machining. The surface of the bit body 14 can be fully or partially machined as well to finish dimensions. The pin portion of the bit can be machined to incorporate threads for mounting the bit to the drill string. Ducts can be included in the casting 10A or can be machined into the bit after casting.

Ducts are generally configured to receive nozzles that direct and shape the output of the fluid, and liners to protect the duct surface from erosion by materials suspended in the fluid. Liners, nozzles and/or other duct components can be retained in the bit with threads, tapers or decreasing diameters of the ducts extending away from the plenum. Casting the plenum using cores provides a range of configurations for the plenum that would be difficult and/or costly to configure by machining. The ducts can be cast to their final shape or cast to a preliminary shape that is later drilled to its final condition. The ducts can also be fully formed by conventional drilling if desired. Alternatively, the plenum can open at both ends of the body and maintain a substantially constant radius.

FIG. 3 shows ducts 18A and 18B. At the upstream opening of duct 18A, the plenum as cast has an extension or transition section 20A extending into the bit body. Similarly duct 18B has an extension or transition 20B proximate the duct upstream opening. The plenum extensions provide a minimum of sharp transitions that can initiate turbulence in the fluid entering the ducts and increase erosion of the plenum surface. A transition between plenum walls 20D and plenum face 20E is curved with a radius of curvature R1. The radius of curvature R1 is greater than R/10 where R is the radius of the throat 20C. Alternatively, R1 is greater than R/5. The core forming the plenum can be defined by corresponding dimensions.

Duct 18B is shown with a liner 22 that can further limit erosion of the duct area. Creating the extensions 20A, 20B by a machining process would require additional steps. Further, the configurations and locations of the extensions would be limited by access of the machine tool to the plenum and/or increase cost of production. Preferably, the duct transitions are formed by casting regardless of whether the ducts are formed by casting, drilling or a combination of process, and regardless of whether the transitions remain unmachined or are at least partially machined after casting. The duct inlets can be radially spaced from the plenum walls to promote flow to the ducts in the plenum. The duct inlet can be radially spaced from the plenum wall by at least one tenth the radius of the plenum throat or R/10.

Figure 3A:
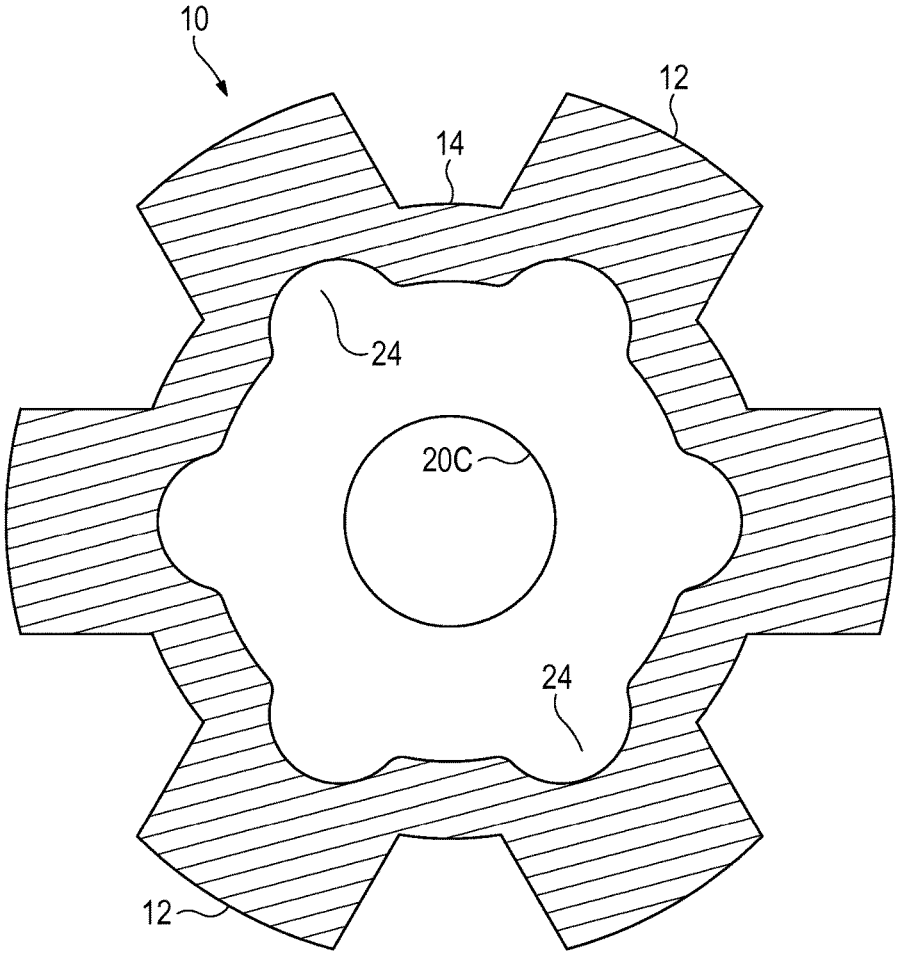
FIG. 3A is a cross section view of the bit of FIG. 2.
Figure 6:
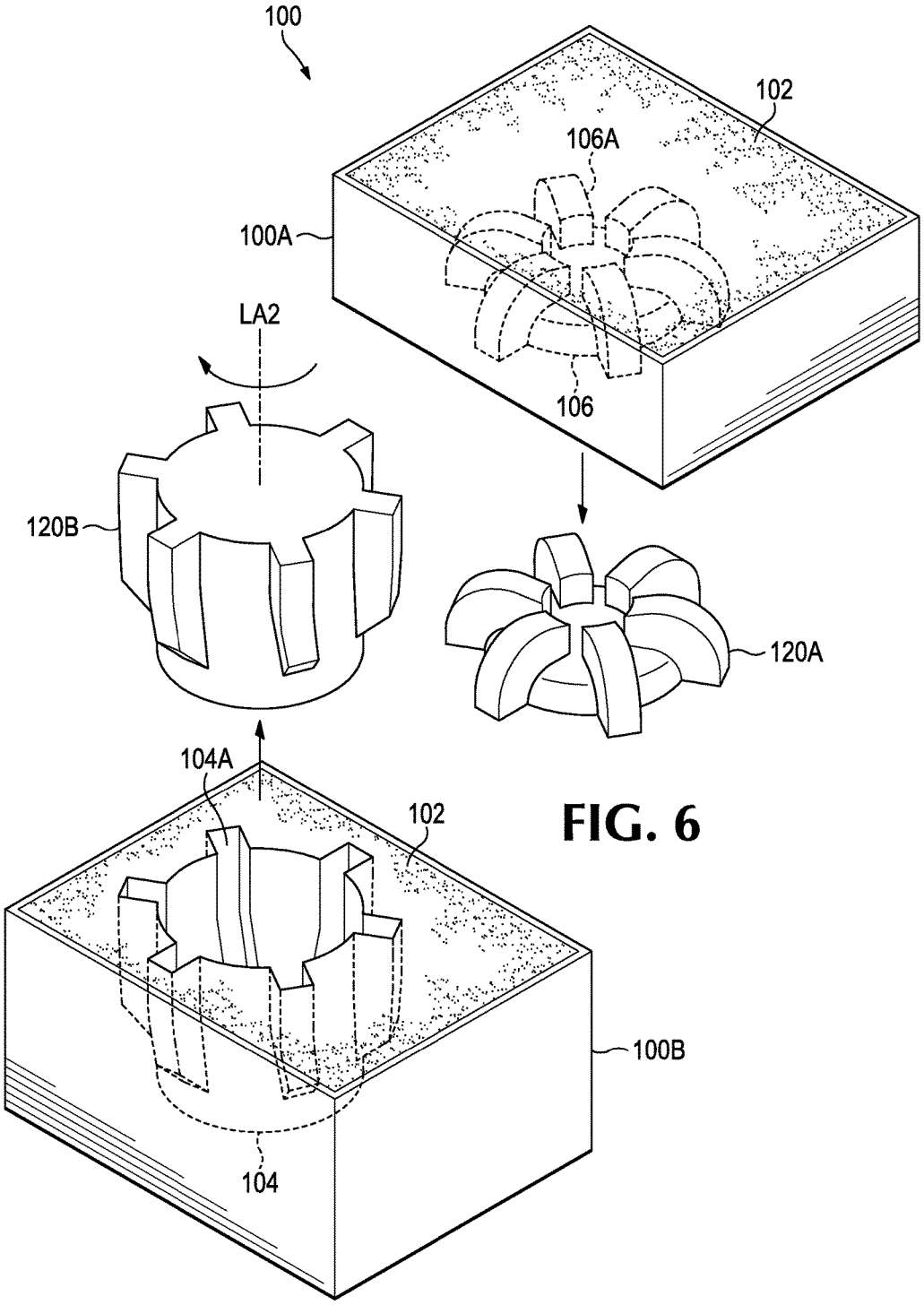
FIG. 6 is a perspective view of patterns being removed from sand molds.
Figure 7:
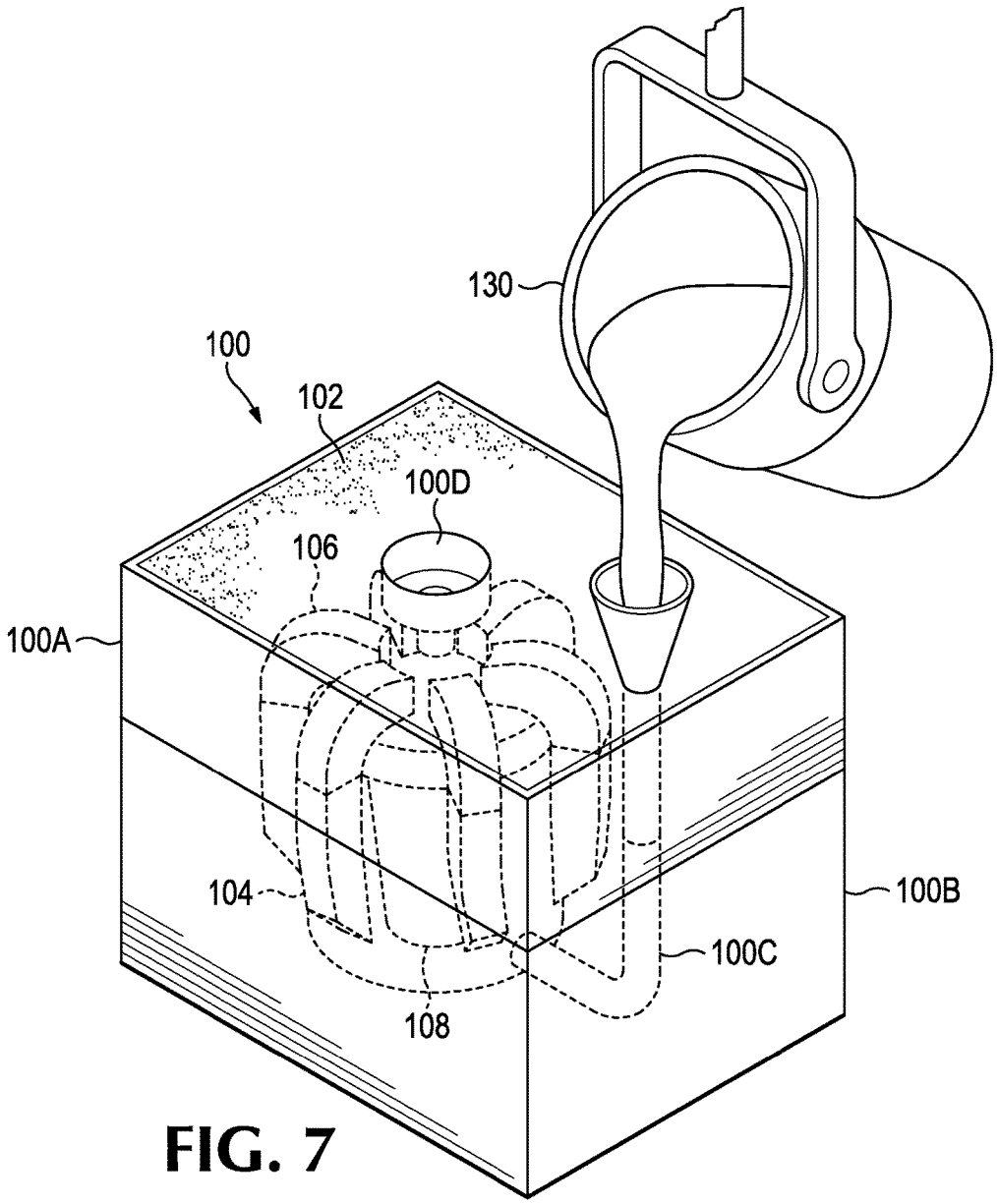
FIG. 7 is a perspective view of a cope and a drag assembled showing hidden cavity components and receiving molten metal in the cavity.

The plenum can include extensions in the wall of the plenum as shown in FIG. 3A. Wall extensions 24 of the plenum can limit the mass of the bit body at the root of the blades 12. During casting excess mass can result in uneven cooling of the casting initiating precipitation of elements in the casting. These areas of uneven composition and dendrite formation can cause cracking on solidification or weakness in the casting. An extension of the plenum at the root of the blades provides even distribution of casting material mass in the mold, allowing it to cool and solidify evenly. This can limit precipitation and dendrite formation. The wall extensions can extend helically along the length of the plenum to follow the extension of the root of the blades on the body of the bit.

A range of extension configurations and duct configurations can be produced by casting that would be difficult to achieve with conventional processes. The plenum configurations shown are examples and are not meant as limitations. Other plenum extension configurations cast using a core will fall within the scope of this disclosure. A range of duct configurations can be cast as well. For example, the core can include features that correspond to a nozzle that directs and shapes the flow of the fluid. Through a casting process, ducts can be configured with curves extending away from the plenum or other complex configurations. Ducts can also be configured with fluted or rifled surfaces.

The plenum acts as a conduit for drilling fluid flowing to the ducts in the front face of the bit and the plenum surface can remain in an as-cast condition. Where dimensions are not critical to the operation of the bit, the external bit body surface can also remain in an as-cast condition. Alternatively, the plenum surface and/or the bit body surface may be machined to remove material.

Machining a casting of a preliminary shaped bit to a final configuration is more efficient than machining a bit from a full billet, requiring less time and fewer steps. Less material has to be removed in machining the casting. Fewer tooling changes are required as fewer milling cutters are consumed and low volume cutting bits can be used. This reduces the cost of manufacturing the bit.

Figure 9:
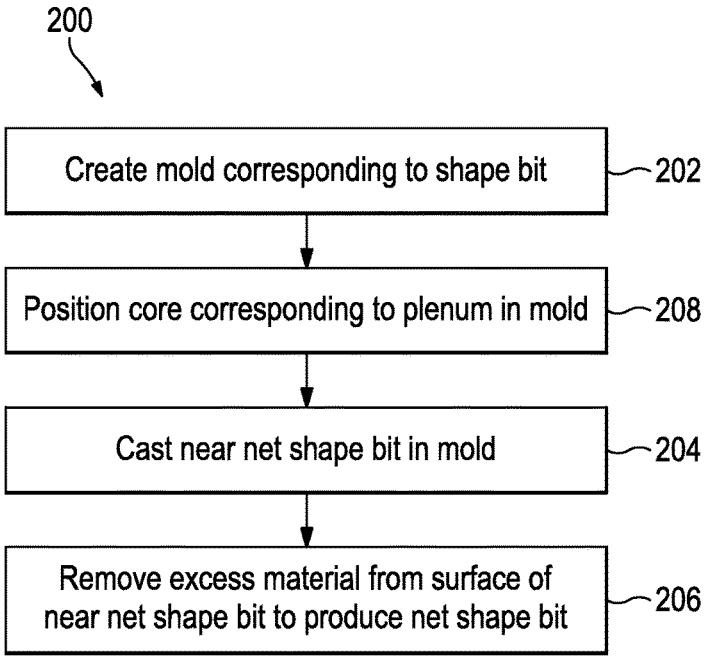
FIG. 9 details steps of an inventive method for producing a downhole bit.

Steps for producing a bit 200 are illustrated in FIG. 9 and include creating a mold with a cavity corresponding to the surface of the bit in step 202. In step 204 a core corresponding to the plenum is positioned in the mold. In step 206 a preliminary shape bit is cast in the mold. In step 208 excess material is removed from the casting to produce a final or net shape bit.

Alternatively, the method can include the step of positioning cores in the mold corresponding to ducts between the plenum core and the mold cavity surface. Alternatively, the method can include creating a duct core that includes features corresponding to a nozzle that directs and shapes the flow of fluid to the bit face. Alternatively, the method can include the step of attaching a pin to the body of the bit for connecting the bit to a drill string. Alternatively, the method can include the step of heat treating the casting to reduce hardness of the material. Alternatively, the method can include the step of heat treating the preliminary shape bit to increase hardness. Alternatively, the method can include machining threads in the upper portion of the casting. Alternatively, the method can include the step of removing excess material to dimension the ducts. Alternatively, the core for the plenum can be asymmetric about the longitudinal axis to include extensions forming cavities in the plenum that promote preferred flow patterns proximate the duct inlets or in the ducts. Alternatively, the method can include selecting casting materials that resist degradation from exposure to corrosives. The casting material can be selected to resist corrosion in a specific borehole with known corrosive conditions.

It should be appreciated that although selected methods of producing a bit, and embodiments of representative cast ferrous bits, are disclosed herein, numerous variations of these embodiments and methods may be envisioned by one of ordinary skill that do not deviate from the scope of the present disclosure. This presently disclosed invention lends itself to use for steel bits as well as a variety of styles of bits.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements.

The invention claimed is:

1. A steel casting for a tool to drill a borehole includes:
a body;
blades extending from the body; and
a plenum in the body;
wherein the blades are machined to a final dimension and the plenum includes extensions to limit the mass of the body at the root of each blade.

2. The steel casting of claim 1 wherein the extensions to limit the mass of the body at the root of each blade extend helically with the root of the blades on the body of the bit.

3. The steel casting of claim 1 wherein the steel casting is heat treated prior to machining to reduce hardness.

4. The steel casting of claim 1 wherein the steel casting is heat treated after machining to increase hardness.

5. The steel casting of claim 1 wherein the steel material of the casting is selected for compatibility with corrosive materials encountered in boreholes.

6. The steel casting of claim 1 wherein threads are machined on the cast bit body for mounting the tool to a drill string.

7. The steel casting of claim 1 wherein the tool is a drag bit.

* * * * *